US008903260B2

(12) United States Patent
Woo

(10) Patent No.: US 8,903,260 B2
(45) Date of Patent: Dec. 2, 2014

(54) IMAGE FORMING APPARATUS AND CONTROL METHOD THEREOF

(71) Applicant: SAMSUNG Electronics Co., Ltd., Suwon-si, Gyeonggi-do (KR)

(72) Inventor: Sangbum Woo, Suwon-si (KR)

(73) Assignee: SAMSUNG Electronics Co., Ltd., Suwon-Si (KR)

( * ) Notice: Subject to any disclaimer, the term of this patent is extended or adjusted under 35 U.S.C. 154(b) by 93 days.

(21) Appl. No.: 13/739,206

(22) Filed: Jan. 11, 2013

(65) Prior Publication Data

US 2013/0183055 A1 Jul. 18, 2013

(30) Foreign Application Priority Data

Jan. 12, 2012 (KR) ..... 10-2012-0003663

(51) Int. Cl.
*G03G 15/16* (2006.01)
*G03G 15/01* (2006.01)

(52) U.S. Cl.
CPC ..... *G03G 15/1605* (2013.01); *G03G 15/0173* (2013.01); *G03G 2215/0158* (2013.01); *G03G 15/161* (2013.01)
USPC ..... 399/66; 399/51; 399/101

(58) Field of Classification Search
USPC ..... 399/51, 66, 101
See application file for complete search history.

(56) References Cited

U.S. PATENT DOCUMENTS 5,652,948 A * 7/1997 Sakaguchi et al. ..... 399/66

* cited by examiner

*Primary Examiner* — Ryan Walsh
(74) *Attorney, Agent, or Firm* — Staas & Halsey LLP

(57) ABSTRACT

An image forming apparatus and a control method include a photosensitive unit having a photosensitive drum, an exposure unit to form an electrostatic latent image on the photosensitive drum, a developing unit to form a toner image by sequentially supplying a plurality of color toners to the electrostatic latent images formed on the photosensitive drum, an intermediate transfer unit having an intermediate transfer belt to perform a first transfer of the toner image formed on the photosensitive drum in a sequential manner by color, a transfer roller configured to perform a second transfer of the toner image on a printing medium , a transfer belt cleaning unit to perform a cleaning task to remove a waste toner that remains on the intermediate transfer belt after the second transfer is performed, and a control unit to start performing idling of the intermediate transfer belt when an exposure with respect to one page toner image is completed and the first transfer is in progress, and to start the second transfer by having the transfer roller make contact with the intermediate transfer belt while the intermediate transfer belt is in an idling state.

17 Claims, 20 Drawing Sheets

IMAGE FORMING APPARATUS AND CONTROL METHOD THEREOF

CROSS-REFERENCE TO RELATED APPLICATIONS

This application claims priority under 35 U.S.C. §119 from Korean Patent Application No. 2012-0003663, filed on Jan. 12, 2012, in the Korean Intellectual Property Office, the disclosure of which is incorporated herein by reference.

BACKGROUND OF THE INVENTION

1. Field of the Invention

Embodiments of the present disclosure relate to an image forming apparatus configured to form a color image through a multi pass scheme, and the control method thereof.

2. Description of the Related Art

In general, an image forming apparatus using an electrophotographic method is an apparatus configured to form an electrostatic latent image on a photosensitive medium by an exposure unit such as a laser scanning unit (LSU) by receiving a digital image signal that corresponds to a desired image, to form a toner image by supplying a toner to the electrostatic latent image by a developing unit, to transfer the toner image to an intermediate transfer belt and to form a desired color image by transferring the toner image to a recording medium.

The colors that are mostly used to form a color image are yellow 'Y' (Yellow 'Y'), magenta 'M' (Magenta 'M'), cyan 'C' (Cyan 'C'), and black 'K' (black 'K'). With respect to forming a color image through an electrophotographic method, a single pass scheme having the total of four exposure units and the total of four photosensitive media that correspond to each color, and a multi pass scheme having a single exposure unit and a single photosensitive medium are included.

The image forming apparatus of a multi pass scheme, when compared to the image forming apparatus of a single pass scheme, is provided with simpler mechanical composition, and thus a miniaturization may be possible, while the cost thereof may be able to be reduced. However, since the photosensitive medium is needed to be rotated four times to form a color image on a single sheet of a recording medium, the printing speed is low, thereby difficult to perform a color registration.

Thus, as to enhance the printing speed of the image forming apparatus of a multi pass scheme, in a stage that the exposure, the developing, and the intermediate transfer with respect to the last color are performed, a transfer roller needs to contact with an intermediate transfer belt, so that the transfer to a recording medium may take place. At this time, by the impact generated as the transfer roller and the intermediate transfer belt are made to be in contact, a shaking may occur on the position of an exposure, and a band may occur on the toner image of the last color.

In addition, in a case when a plurality of recording media is consecutively being printed, as to shorten the printing time, in the stage in which the exposure, the developing, and the intermediate transfer take place with respect to the first color of the next recording medium, a cleaning task is being performed to remove the remaining toner. The cleaning task applies a load to the intermediate transfer belt and causes a speed change, thereby generating the registration offset of the first color.

SUMMARY OF THE INVENTION

The present general inventive concept provides an image forming apparatus and a control method thereof, capable of reducing a color registration offset caused by a cleaning operation of a cleaning member and preventing an occurrence of a band caused by an impact that is generated when a transfer roller and an intermediate transfer belt are in contact, by adding a process of idling the intermediate transfer belt without a mechanical change with respect to the image forming apparatus of a multi pass scheme and by allowing the transferring of a toner image to a recording medium and the cleaning operation of the cleaning member to be performed during a time when the intermediate transfer belt is in an idling state.

Additional features and utilities of the present general inventive concept will be set forth in part in the description which follows and, in part, will be obvious from the description, or may be learned by practice of the general inventive concept The foregoing and/or other features and utilities of the present general inventive concept may be achieved by providing an image forming apparatus configured to generate a color image using a multi pass scheme, the image forming apparatus including a photosensitive unit, an exposure unit, a developing unit, an intermediate transfer unit, a transfer roller, a transfer belt cleaning unit and a control unit. The photosensitive unit may include a photosensitive drum and a first driving unit. The photosensitive drum may have an outer circumferential surface on which electrostatic latent images are formed. The first driving unit may be configured to rotate the photosensitive drum. The exposure unit may be configured to form the electrostatic latent images on the outer circumferential surface of the photosensitive drum by radiating light on the photosensitive drum. The developing unit may be configured to form toner images by sequentially supplying a plurality of color toners to the electrostatic latent images formed on the outer circumferential surface of the photosensitive drum. The intermediate transfer unit may include an intermediate transfer belt, and a second driving unit. The intermediate transfer belt may allow a first transfer of the toner images formed on the outer circumferential surface of the photosensitive drum to be proceeded in a sequential manner by colors. The second driving unit may be configured to rotate the intermediate transfer belt. The transfer roller may be configured in a way that a second transfer of the toner images is processed on a printing medium by applying a predetermined pressure to the printing medium that passes in between the intermediate transfer belt and the transfer roller while in contact with the intermediate transfer belt. The transfer belt cleaning unit may be configured to perform a cleaning task to remove a waste toner that remains on the intermediate transfer belt after the second transfer is performed. The control unit may be configured to start idling of the intermediate transfer belt when an exposure with respect to one page is completed and the first transfer is in progress, and configured to start the second transfer by having the transfer roller make contact with the intermediate transfer belt while the idling of intermediate transfer belt is in progress.

The control unit may be configured in a way that an exposure with respect to a next page is started after the idling is completed.

The control unit may be configured to increase a speed of the second driving unit during a period from the moment of the completion of the first transfer with respect to the one image to the moment prior to the starting of the second transfer with respect to the one image.

The control unit may be configured to increase a speed of the second driving unit during a period from the moment of the completion of the first transfer with respect to the one page to the moment prior to the starting of an exposure with respect to a next color image.

The control unit may be configured to increase a speed of the second driving unit at the time of the cleaning task of the transfer belt cleaning unit is being performed.

The control unit may be configured to increase a speed of the second driving unit according to the amount of a decelerating speed of the intermediate transfer belt caused by a cleaning load that occurs at the time of the cleaning task is being performed.

The control unit may be configured to rotate the intermediate transfer belt twice in an idling state, to start the second transfer by allowing the transfer roller make contact with the intermediate transfer belt while a first idling is in progress, to have the transfer belt cleaning unit to perform the cleaning task when the waste toner remaining on the intermediate transfer belt after the second transfer is completed is arrived at a cleaning position, and to have the cleaning task to be completed while a second idling is in progress.

The control unit, during a period from the moment of the completion of the first transfer with respect to the one page to the moment prior to the starting of an exposure of a next page, may be configured to increase the speed of the second driving unit.

The foregoing and/or other features and utilities of the present general inventive concept may also be achieved by providing a method of controlling an image forming apparatus of a multi pass scheme configured to form electrostatic latent images by exposing an outer circumferential surface of a photosensitive drum to develop the electrostatic latent images into toner images by using a plurality of color toners having different colors to each other, to perform a first transfer of the toner images to an intermediate transfer belt by colors, to perform a second transfer by having a transfer roller make contact with the intermediate transfer belt, and to remove a waste toner that remains on the intermediate transfer belt after the second transfer is performed. The method may include Idling the intermediate transfer belt when an exposure with respect to one page is completed and the first transfer is in progress. The second transfer may be started by having the transfer roller make contact with the intermediate transfer belt when the idling is in progress.

The second transfer may be configured to start when a toner image, which is atoner image to be transferred on a printing medium first, among the toner images having been subject to the first transfer is arrived at a second transfer position.

During a period from the moment of the completion of the first transfer with respect to the one page to the moment prior to the starting of the second transfer with respect to the one page, a speed of a driving motor that drives the intermediate transfer belt may be increased.

During a period from the moment of the completion of the first transfer with respect to the one page to the moment prior to the starting of an exposure with respect to a next color image, a speed of the driving motor that drives the intermediate transfer belt may be increased.

During the time when the waste toner is being removed, a speed of the driving motor that drives the intermediate transfer belt may be increased.

The amount of the speed increase of the driving motor may be determined by the amount of a decelerating speed of the intermediate transfer belt caused by a cleaning load that occurs at the time of the waste toner is being removed.

The intermediate transfer belt may be rotated at idle twice when the exposure with respect to the one page is completed. During a first idling, the second transfer may be started by having the transfer roller make contact with the intermediate transfer belt. The cleaning task may be started to remove the waste toner that remains after the second transfer is completed. During a second idling, the cleaning task may be completed.

During a period from the moment of the completion of the first transfer with respect to the one page to the moment of the completion of the cleaning task, the speed of the driving motor that drives the intermediate transfer belt may be increased.

The foregoing and/or other features and utilities of the present general inventive concept may also be achieved by providing a computer readable medium to contain computer-readable codes as a program to execute the method described above or hereinafter.

The foregoing and/or other features and utilities of the present general inventive concept may also be achieved by providing an image forming apparatus of a multi pass scheme, the image forming apparatus including a photosensitive unit, an exposure unit to form one or more electrostatic latent images of a first page on the photosensitive unit, a developing unit to develop the one or more electrostatic latent images with one or more developers, an intermediate transfer unit, a transfer unit; and a control unit configured to perform a first transfer to transfer the one or more developed images of the first page to the intermediate transfer unit, to perform a second transfer to transfer a toner image of the intermediate transfer unit to a printing medium, and to control the exposure unit to form a next electrostatic latent image of a second page after starting the second transfer.

The control unit may control the intermediate transfer unit to idle in an idling period after completing the forming of the one or more electrostatic latent images of the first page on the photosensitive unit before starting a electrostatic latent image of a second page.

The control unit may control the intermediate transfer unit to idle when an exposure with respect to the first page is completed and the first transfer is in progress, and to start the second transfer when the idling is in progress.

The image forming apparatus may further include a transfer belt cleaning unit disposed adjacent to the intermediate transfer unit, and the control unit may control a transfer belt cleaning unit to clean the intermediate transfer unit during an idling period of the intermediate transfer unit.

BRIEF DESCRIPTION OF THE DRAWINGS

These and/or other features and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
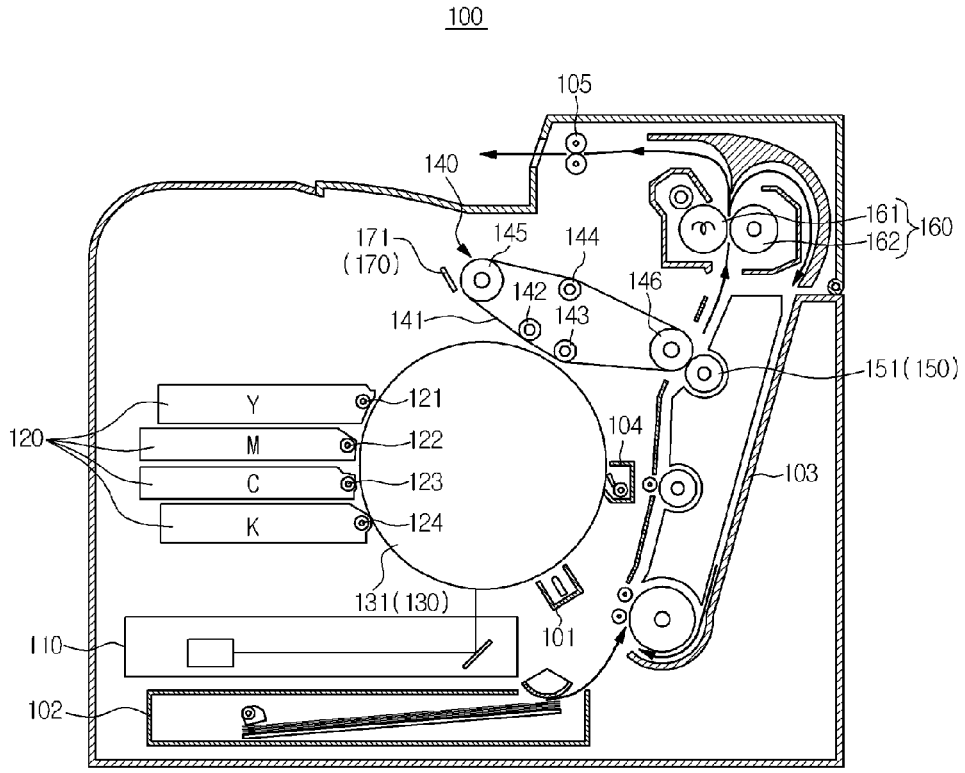
FIG. 1 is a side cross-sectional view illustrating an image forming apparatus according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

FIG. 1 is a side cross-sectional view illustrating an image forming apparatus 100 according to an embodiment of the present general inventive concept.

Referring to FIG. 1, the image forming apparatus 100 performs a multi pass scheme to perform one or more image forming process to form a color image and/or to perform one or more image transfer processes to transfer color images to one or more paper sheets. The image forming apparatus 100 includes an exposure unit 110, a photosensitive unit 130, a developing unit 120, an intermediate transfer unit 140, a paper feeding cassette 102, a transferring unit 150, a transferring unit 150, a fixing unit 160, a transfer belt cleaning unit 170, and a paper discharging unit 105.

The photosensitive unit 130 includes a photosensitive medium 131, and the photosensitive medium 131 is a photosensitive drum provided with a photoelectric layer formed at an outer circumferential surface of a metallic drum having a cylindrical shape. When a toner image is formed at the outer circumferential surface of the photosensitive drum, the toner image is transferred on a printing medium, for example, a paper through an intermediate transfer belt, so that a user may be able to obtain the desired color image. Hereinafter, in the embodiments to be described, the photosensitive drum will be used as the photosensitive medium.

At the surroundings of the photosensitive drum 131, a charging unit 101 and a photosensitive drum cleaning unit 104 are installed.

The charging unit 101 is configured to charge the photosensitive drum 131 to a constant electric potential, and a charging roller or a corona charging apparatus may be employed. The charging unit 101 may be disposed to rotate in a contact or in a non-contact state with the outer circumferential surface of the photosensitive drum 131. The charging unit 101 is configured to supply an electrical charge, so that the outer circumferential surface of the photosensitive drum 131 is provided with a constant electric potential.

The photosensitive drum cleaning unit 104 is configured to remove the toner image that remains on the photosensitive drum 131 without being transferred to the intermediate transfer unit 140 from the photosensitive drum 131, and may employ a cleaning blade.

The developing unit 120 includes a plurality of developers configured to accommodate a plurality of toners in a form of solid powder having different colors to each other. The plurality of developers is disposed in order in a rotating direction while facing the photosensitive drum 131. The plurality of developers may be respectively capable of accommodating toners of yellow 'Y', magenta 'M', cyan 'C', and black 'K', for example. The plurality of developers is respectively provided with developing rollers 121, 122, 123, and 124, that are configured to supply toners to corresponding electrostatic latent images formed at the photosensitive drum 131 to develop the electrostatic latent image into a toner image.

In addition, the plurality of developers are installed in a way that the developing rollers 121, 122, 123, and 124 are spaced apart from the outer circumferential surface of the photosensitive drum 131 as much as a developing gap, and the developing gap may be set to be about tens or hundreds of microns, for example.

The exposure unit 110 is installed at a lower side of the photosensitive drum 131, and is configured to form an electrostatic latent image by radiating light at the photosensitive drum 131 that is charged with the constant electric charge.

The intermediate transfer unit 140 includes an intermediate transfer belt 141, a plurality of supporting rollers 142, 143, 144, 145, and 146 to support and rotate the intermediate transfer belt 141, and a driving unit (not illustrated) to drive the supporting rollers to rotate the intermediate transfer belt 141. The present general inventive concept is not limited thereto. It is possible that the number and position of the supporting rollers can be variable according to a design and user preference as long as the intermediate transfer belt is driven and supported. The intermediate transfer belt 141 is installed to face the photosensitive drum 131, and when the driving unit of the intermediate transfer unit 140 drives the supporting rollers, the intermediate transfer belt 141 is rotated, and a toner image is transferred from the photosensitive drum 131 to the intermediate transfer belt 141. Hereinafter, the transfer from the photosensitive drum 131 to the intermediate transfer belt 141 is referred to as a first transfer.

At this time, a linear speed of the intermediate transfer belt 141 may be set as same as a linear rotation speed of the photosensitive drum 131, and a length of the intermediate transfer belt 141 may be same as or longer than a length of a paper sheet on which a toner image is printed. As an embodiment of the present general inventive concept, the length of the intermediate transfer belt 131 may be a sum of the length of the paper sheet and a length of a gap (or a distance) between the paper sheets to be fed and printed.

The image forming apparatus according to an embodiment of the present general inventive concept employs a multi pass scheme. Thus, by using the plurality of toners included in the plurality of developers, electrostatic latent images are sequentially developed to form sub-toner images, and by transferring each sub-toner image on the intermediate transfer belt 131 in an overlapping manner, a color image (toner image) is formed, thereby to obtain a high-quality image.

In detail, an electrostatic latent image corresponding to a color that is formed first, for example, yellow 'Y', is formed on the photosensitive drum 131 by a laser beam discharged from the exposure unit 110 according to an image signal, and by a yellow 'Y' developer, the electrostatic latent image is developed into a yellow 'Y' toner image. The yellow 'Y' toner image formed on the photosensitive drum 131 is transferred to the intermediate transfer belt 141 by a first transfer bias voltage and a first transfer bias pressure that are applied to the intermediate transfer belt 141.

Using the same method, the color images that is to be formed next, for example, each of the magenta 'M', the cyan 'C', and the black 'K' images are formed on the photosensitive drum 131 by the respective colors, and each of the magenta 'M', the cyan 'C', and the black 'K' images is transferred to the intermediate transfer belt 131 in an overlapping manner by the first transfer bias voltage and pressure. As a result of the above operation, a first transfer image having the sub-toner images of the magenta 'M', the cyan 'C', and the black 'K' overlapped thereon is formed on the intermediate transfer belt 141 as a color image (toner image).

The first transfer image formed on the intermediate transfer belt 141, according to a second transfer bias voltage and second transfer bias pressure that are applied on a paper sheet, is transferred to a paper sheet by a transfer roller 151 of the transferring unit 150.

At the surroundings of the intermediate transfer unit 140, the transfer belt cleaning unit 170 configured to remove the remaining waste toner is installed. The transfer belt cleaning unit 170 is disposed in a way that a transfer belt cleaning member 171 of the transfer belt cleaning unit 170 is in contact with and is spaced apart from the intermediate transfer belt 141 by a moving unit (not illustrated) of the transfer belt cleaning unit 170, and is configured to remove a remaining waste toner on the intermediate transfer belt 131 after the toner image is transferred to a paper sheet. The transfer belt cleaning member 171 may employ a cleaning blade configured to scrape the remaining waste toner while being in contact with a surface of the intermediate transfer belt 141.

The transfer roller 151 installed to be in contact with and be spaced apart from the intermediate transfer belt 141. The transfer roller 151 may be installed to face the intermediate transfer belt 141. In a case when a transfer from the intermediate transfer belt 141 to a paper sheet (hereinafter called as 'a second transfer') is not taken place, the transfer roller 151 remains to be spaced apart from the intermediate transfer belt 141, and when the second transfer is taken place, the transfer roller 151 makes contact with the intermediate transfer belt 141 at a predetermined pressure, according to a driving unit (not illustrated) of the transferring unit 150, so that the toner image formed on the intermediate transfer belt 141 is transferred to a paper sheet 'S'.

The fixing unit 160 includes a heating roller 161 to generate heat, and a pressing roller 162 configured to press a paper sheet against the heating roller 161 while rotating in a state of facing the heating roller 161, and by applying heat to the toner image that is transferred on a paper sheet, the toner image is fixed to the paper sheet. However, the present general inventive concept is not limited thereto. It is possible that a heating roller may be used as a pressing roller disposed to face a roller in the fixing unit 160.

The paper discharging unit 105 is provided with a pair of rollers to discharge the paper sheet having the toner image fixed thereon to an outside thereof. The paper sheet discharged from the paper discharging unit 105 is accumulated in a paper loading tray of the body of the image forming apparatus 100.

The paper feeding cassette 102 is configured to load one or more paper sheets, and is installed at a body of the image forming apparatus 100 in an attachable/detachable manner, and at an upper side of the paper feeding cassette 102, a pick-up roller is provided to pick up a paper sheet at a time.

In addition, by providing a duplex transporting unit 103, the paper 'S' having an image formed on one side thereof may be returned to a paper feeding path through a duplex feeding path, so that print images can be formed on both sides of the paper 'S'.

Figure 2:
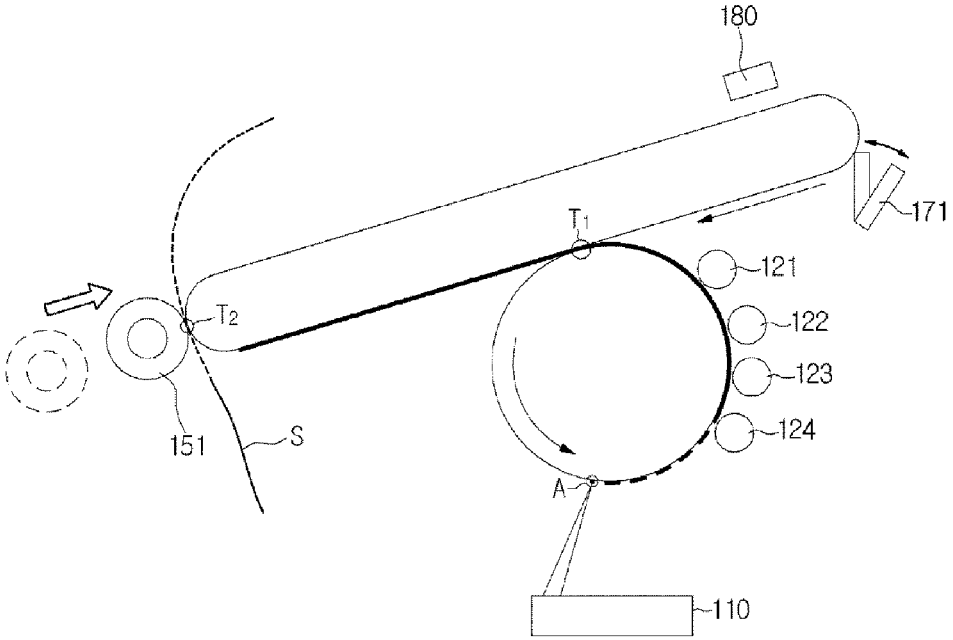
FIG. 2 is a side cross-sectional view illustrating an intermediate transfer unit, a developing unit, a transfer roller, and a photosensitive drum of the image forming apparatus of FIG. 1.
Figure 3:
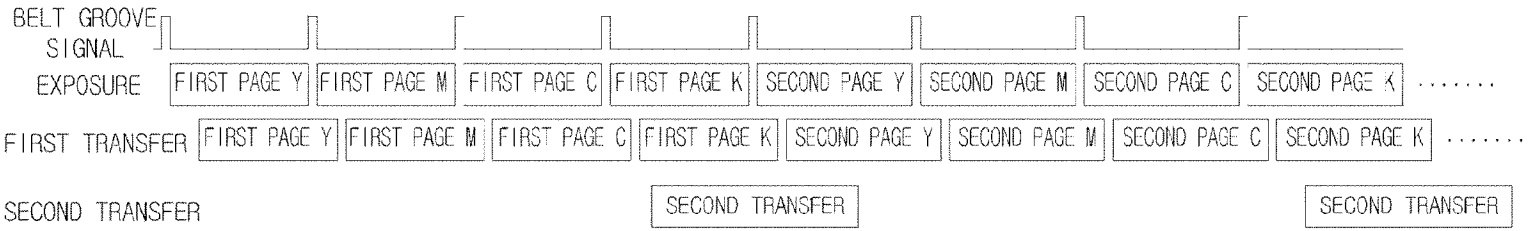
FIG. 3 is a timing chart illustrating a method of an image forming apparatus consecutively printing two sheets of color image.

FIG. 2 is a side cross-sectional view illustrating the intermediate transfer unit 140, the developing unit 120, the transfer roller 151, and the photosensitive drum 131 of the image forming apparatus 100 of FIG. 1 according to an embodiment of the present general inventive concept. FIG. 3 is a timing chart illustrating an image forming apparatus consecutively printing color images on two paper sheets Hereinafter, by referring to FIGS. 2 to 3, it is possible to perform the exposure with respect to a second color image is started immediately after the exposure with respect to a first color image.

Referring to FIG. 2, the intermediate transfer belt 141 of the image forming apparatus 100 may be provided with a groove formed at a surface of the intermediate transfer belt 141. The groove may be recognized by a sensor disposed at a portion to detect the surface of the intermediate transfer belt 141. A groove sensor 180 is mounted at a position of the image forming apparatus 100 near the intermediate transfer belt 141 to recognize the groove. The groove and the groove sensor 180 are configured to measure a rotation speed or a number of rotations of the intermediate transfer belt 141. However, the present general inventive concept is not limited thereto. It is possible that a predetermined pattern may be usable to be detected by a sensor to measure the rotation speed and number of the intermediate transfer belt 141.

Referring to FIGS. 2 and 3, the image forming apparatus 100 in the multi pass scheme performs the exposure to the photosensitive drum 131 and the first transfer to the intermediate transfer belt 141 at each of the colors, and in one embodiment of the present disclosure, the exposure with respect to each of the colors is considered to be started when the groove sensor 180 recognizes the groove of the intermediate transfer belt 141. When the exposure is being performed with respect to one color, the intermediate transfer belt 141 makes one revolution, and the developing of the one color is performed to form a sub-toner image according to the exposure operation.

The toner image processed according to the first transfer to the intermediate transfer belt 141 is processed to a paper sheet according to the second transfer. Thus, when a color image is needed to be formed by using the toners of the four colors, the intermediate transfer belt 141 makes a total of four revolutions for the exposure to be performed. When a portion of the outer circumferential surface of the first photosensitive drum 131, on which the exposure and the developing are performed, arrives at the intermediate transfer belt 141,the first transfer starts, so the first transfer is performed after the exposure. In addition, when the toner image having completed with the first transfer with respect to the last color arrives at a position at which the toner image meets with the transfer roller (hereinafter called a 'second transfer position'), the second transfer starts, so the second transfer is performed. Thus, when the first transfer and the second transfer are completed with respect to a color image (toner image), the intermediate transfer belt 141 is rotated for the total of the four or five revolutions.

The exposure, developing, and first transfer are performed as describe above. However, the present general inventive concept is not limited thereto. The exposure, developing, and first transfer may be performed in the order of the yellow 'Y', the magenta 'M', the cyan 'C', and the black 'K'.

The image forming apparatus 100 may enhance a printing speed, and the second transfer may be performed when the exposure, the developing, and the first transferring of the last color are performed. That is, when the exposure unit is performing an exposure with respect to the image of the last color on the photosensitive drum 131, the transfer roller 151 makes contact with the intermediate transfer belt 141. At this time, as the transfer roller 151 makes contact with the intermediate transfer belt 141, an impact may generated, and the impact may be delivered to the photosensitive drum 131, causing a shaking on a position of exposure with respect to the photosensitive drum 131.

Figure 4:
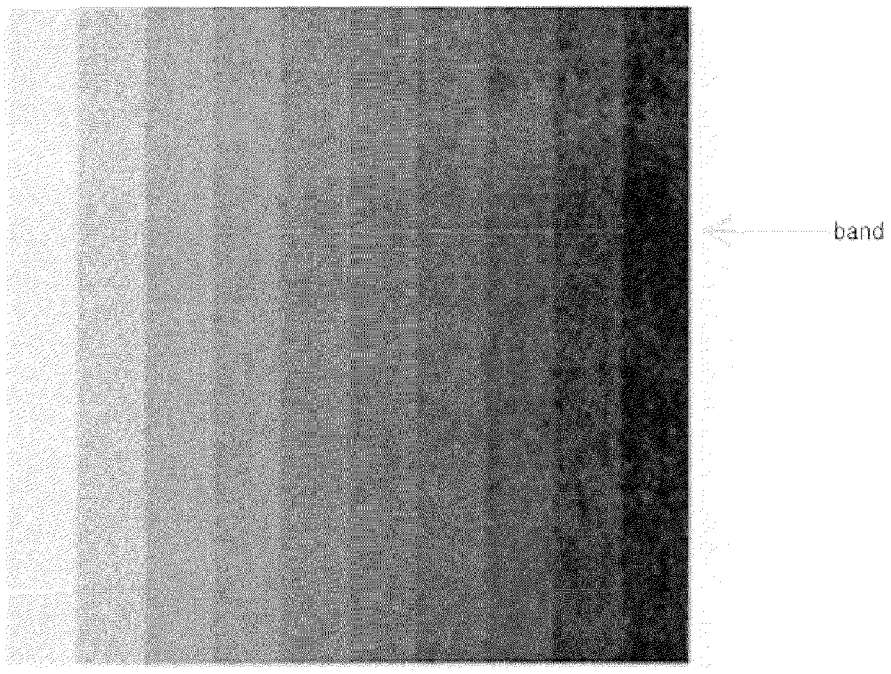
FIG. 4 is a view illustrating a band generated on a color image caused by the shaking of a position of an exposure.
Figure 5:
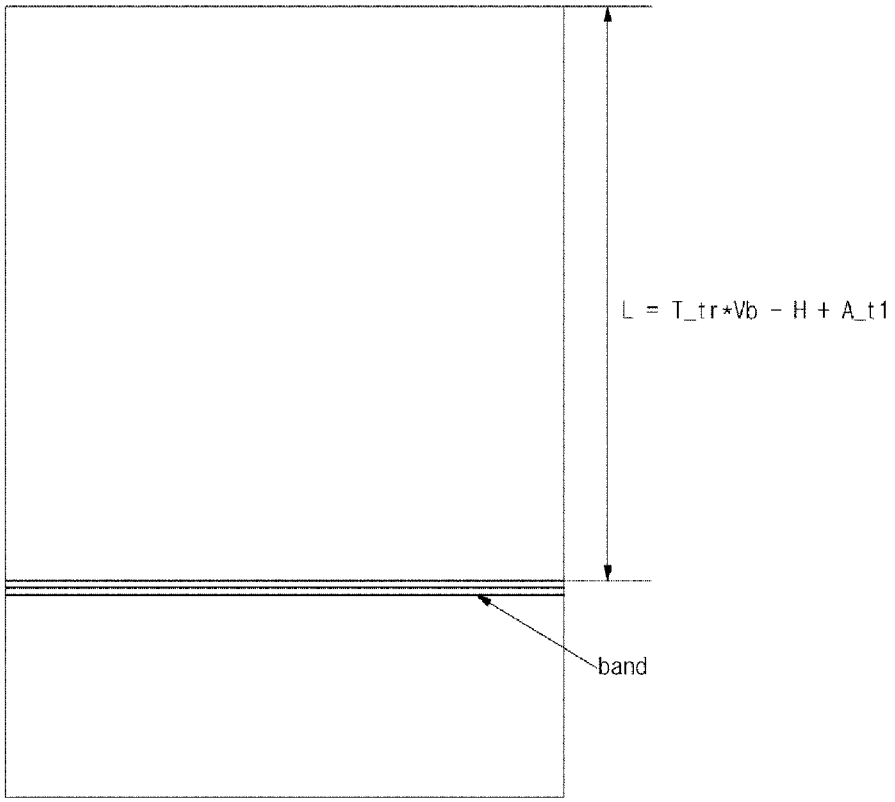
FIG. 5 is a view illustrating the position of the exposure at which a band is generated on a paper.

FIG. 4 is a view illustrating a band generated on a color image caused by the shaking of a position of an exposure. FIG. 5 is a view illustrating the position at which a band is generated on a paper sheet.

If the impact is delivered to the photosensitive drum 131 while the exposure is being performed, a shaking is occurred on the position of the exposure, and when the color image having the exposure position that is shaken is processed with the second transfer to a paper after the first transfer, as illustrated on FIG. 4, a band is generated. The band that is illustrated on the color image degrades the quality of the image.

Referring back to FIG. 2, a position 'A' is referred to as the position of the exposure of the photosensitive drum 131 at which the exposure unit 110 radiates light, a position '$T_1$' is referred to as the position at which the photosensitive drum 131 and the intermediate transfer belt 141 meet, that is, the first transfer position, and the position '$T_2$' is referred to as the position at which the intermediate transfer belt 141 and the transfer roller 151 with respect to a paper feeding path meet, that is, the second transfer position. If a length 1' is set as a length from the position 'A', through the position '$T_1$', and to the position '$T_2$', when the transfer roller 151 is being in contact with the intermediate transfer belt 141 for the second transfer, the shaking is occurred at the position of the exposure with respect to the last color at the position 'A', and the band caused by the shaking, as illustrated on FIG. 5, is shown on a paper sheet after the second transfer is progressed up to a length corresponding to the length 'L'.

When a speed of the intermediate transfer belt 141 is set at $v_b$, a time taken for the groove of the intermediate transfer belt 141 to arrive at the position at which the groove and the transfer roller meet after the groove is passed by the groove sensor is T_tr. In addition, When a distance from the position of the groove sensor to the position '$T_1$' is referred to as 'H', and that a distance from the position 'A' to the position '$T_1$' is referred to as the 'A_ $t_1$', the length 'L' may be calculated by the [Mathematical Formula 1] below:

$$L=T_tr*v_b-H+A_t_1 \quad \text{[Mathematical Formula 1]}$$

Figure 6:
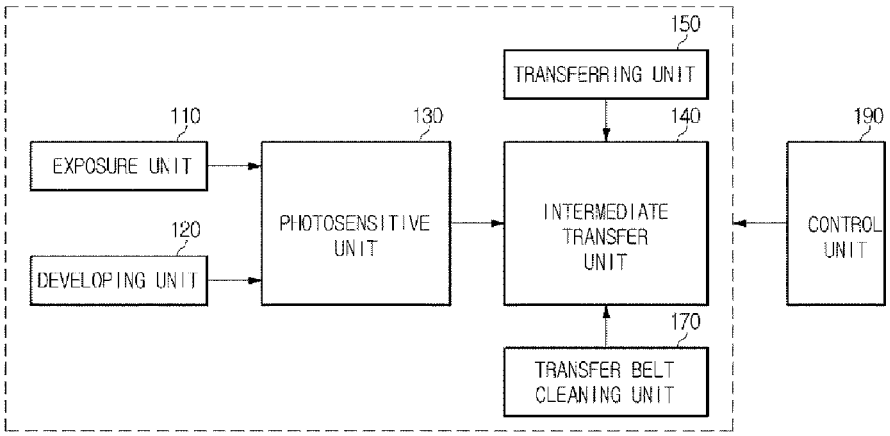
FIG. 6 is a control block diagram illustrating an image forming apparatus according to an embodiment of the present general inventive concept.

FIG. 6 is a control block diagram briefly illustrating an operation of an image forming apparatus according to an embodiment of the present general inventive concept.

The image forming apparatus of FIG. 6 may be similar to the image forming apparatus 100 of FIG. 1. Referring to FIG. 6, the image forming apparatus includes the photosensitive unit 130, the exposure unit 110, the developing unit 120, the intermediate transfer unit 140, the transferring unit 150, the transfer belt cleaning unit 170, and a control unit 190.

The photosensitive unit 130 includes the photosensitive drum 131 having an outer circumferential surface on which an electrostatic latent image and a toner image are formed, and a driving unit (hereinafter called a first driving unit) configured to rotate the photosensitive medium 131. Here, the first driving unit may employ a driving motor.

The exposure unit 110, as described on FIG. 1, forms an electrostatic latent image by radiating light on the outer circumferential surface of the photosensitive medium 131, and the developing unit 120 forms a sub-toner image by developing an electrostatic latent image with a corresponding toner.

The intermediate transfer unit 140, as described on FIG. 1, includes the intermediate transfer belt 141, a plurality of supporting rollers to support and rotate the intermediate transfer belt 141, and a driving unit (hereinafter called a second driving unit) to drive the supporting rollers. Here, the second driving unit may employ a driving motor.

The transferring unit 150 includes the transfer roller 151 making contact with the intermediate transfer belt 141 at a predetermined pressure, a driving unit (hereinafter called a third driving unit) configured to allow the transfer roller 151 be spaced apart from and make contact with the intermediate transfer belt 141, and another driving unit to rotate the transfer roller 151. However, it is possible that the driving unit and the another driving unit may use a single deriving power source.

The transfer belt cleaning unit 170 includes a cleaning member 171 to remove the remaining waste toner of the intermediate transfer belt 141, and a driving unit (hereinafter called a fourth driving unit) configured to allow the cleaning member to be spaced apart from and make contact with the intermediate transfer belt 141.

The control unit 190 is configured to control the operations of the photosensitive unit 130, the exposure unit 110, the intermediate transfer unit 140, the transferring unit 150, and the transfer belt cleaning unit 170 and the transferring unit 150. The control unit 190 is configured to control the timing of the operation of each unit such that the contact of the transfer roller 151 and the intermediate transfer belt 141 for the second transfer may be performed after the exposure with respect to the black 'K', which is the last color from the total of the four colors, is completed, thereby preventing a band from generated on the color image on a paper sheet.

Hereinafter, the embodiment of the present disclosure will be described by separately describing a case when the image forming apparatus prints a single sheet of a color image from a case when the image forming apparatus prints a multiple number of color images.

Figure 7:
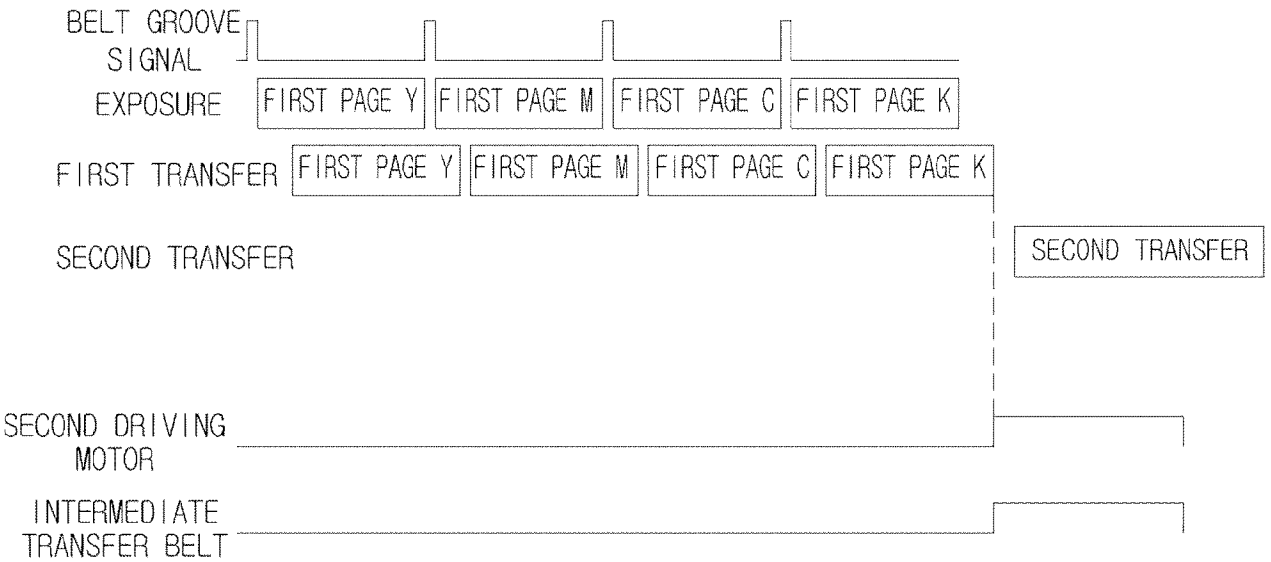
FIG. 7 is a timing chart illustrating an operation of an image forming apparatus to perform a printing of a single sheet of a color image according to an embodiment of the present general inventive concept.
Figure 8:
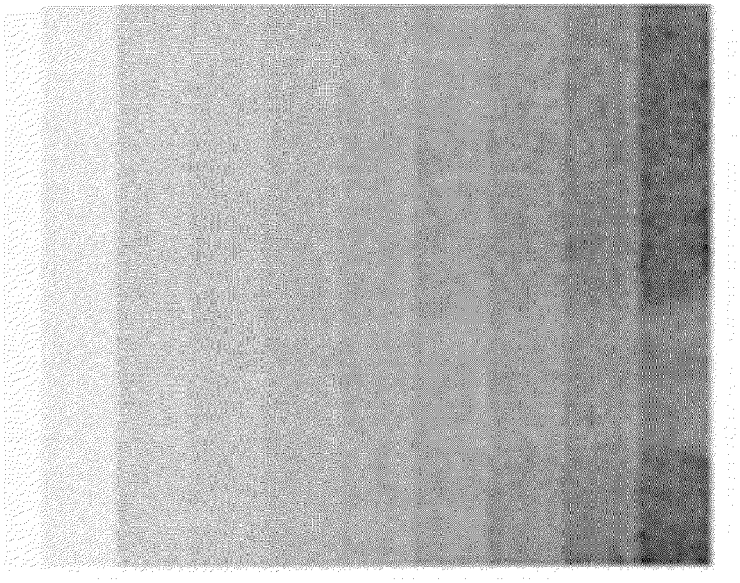
FIG. 8 is a view illustrating a color image printed by an image forming apparatus according to an embodiment of the present general inventive concept.

FIG. 7 is a timing chart illustrating an operation of an image forming apparatus in a case when the image forming apparatus performs a printing of a single sheet of a color image according to an embodiment of the present general inventive concept. FIG. 8 is a view illustrating a color image printed by the image forming apparatus according to an embodiment of the present general inventive concept.

Referring to FIG. 7, the image forming apparatus according to an embodiment of the present general inventive concept starts the second transfer after the exposure with respect to the black 'K' is all completed. Thus, even when the transfer roller 151 and the intermediate transfer belt 141 are in contact, the shaking of the position of the exposure by the contact of the transfer roller 151 and the intermediate transfer belt 141 is not occurred, and as illustrated on FIG. 8, the band is not generated on the color image that is printed.

However, the second transfer may be not immediately started after the completion of the exposure with respect to the black 'K', and the second transfer is started when a toner image, which is to be transferred first to a paper sheet, among the toner images transferred on the intermediate transfer belt 141, is arrived at the second transfer position.

Then, the control unit 190, after the first transfer with respect to the black 'K' is completed, increases a speed of the second driving motor, so that a rotation speed of the intermediate transfer belt 141 is accelerated to a speed for a next image forming operation, thereby to avoid the reduction of the printing speed.

Figure 9:
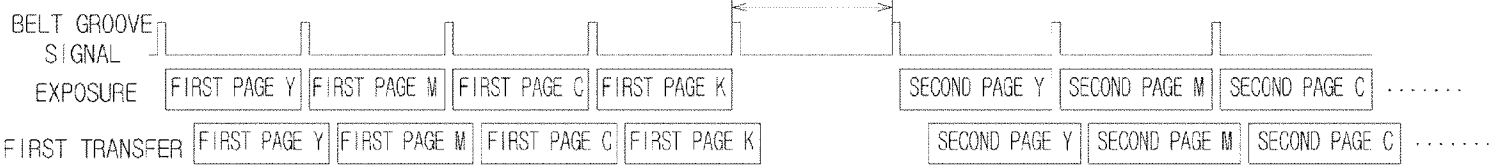
FIG. 9 is a timing chart illustrating an image forming apparatus to consecutively print color images on more than two sheets according to an embodiment of the present general inventive concept.

FIG. 9 is a timing chart illustrating an operation of an image forming apparatus to consecutively print color images on more than two paper sheets according to an embodiment of the present general inventive concept.

In a case when color images are being printed on more than two paper sheets, as illustrated on FIG. 3, after the exposure with respect to the first color image is all completed, the exposure with respect to the second color image is started immediately. As a reference, since the image forming apparatus according to an embodiment is configured to print a color image on a page unit basis, a first color image is referred to as the color image that is to be printed on a first page, and a second color image is referred to as the color image that is to be printed on a second page.

In the image forming apparatus as illustrated on FIG. 9, after the exposure with respect to the first color image is all completed, t the exposure with respect to the second color image may not be immediately started, but an idling period at least for one revolution is provided during which no exposure is performed. Here, the idling period is referred to as a period during which no exposure is performed on the photosensitive drum 131while the intermediate transfer belt 141 is rotated.

Then, after the idling period is passed, the image forming apparatus starts the exposure with respect to the second color image, and during the idling period, the second transfer with respect to the first color image is started. That is, the control unit 190 enables the transfer roller 151 to be in contact with the intermediate transfer belt 141 by use of the third driving unit. Like as when one sheet of a color image is being printed, when the toner image, which is to be transferred first on a paper sheet, is arrived at the second transfer position, the second transfer is started. Since the second transfer is performed when no exposure is performed with respect to the photosensitive drum 131, even when the transfer roller and the idle transfer belt 141 are in contact, the shaking of the position of the exposure is not occurred.

The exposure with respect to a third color image may be performed after the exposure with respect to the second color image is completed and the idling period is passed. The second transfer with respect to the second color image is started during the idling period. Although FIG. 9 illustrates the idling set at one revolution, the present general inventive concept is not limited thereto. It is possible that more than one revolution may be set as the period.

Figure 10A:
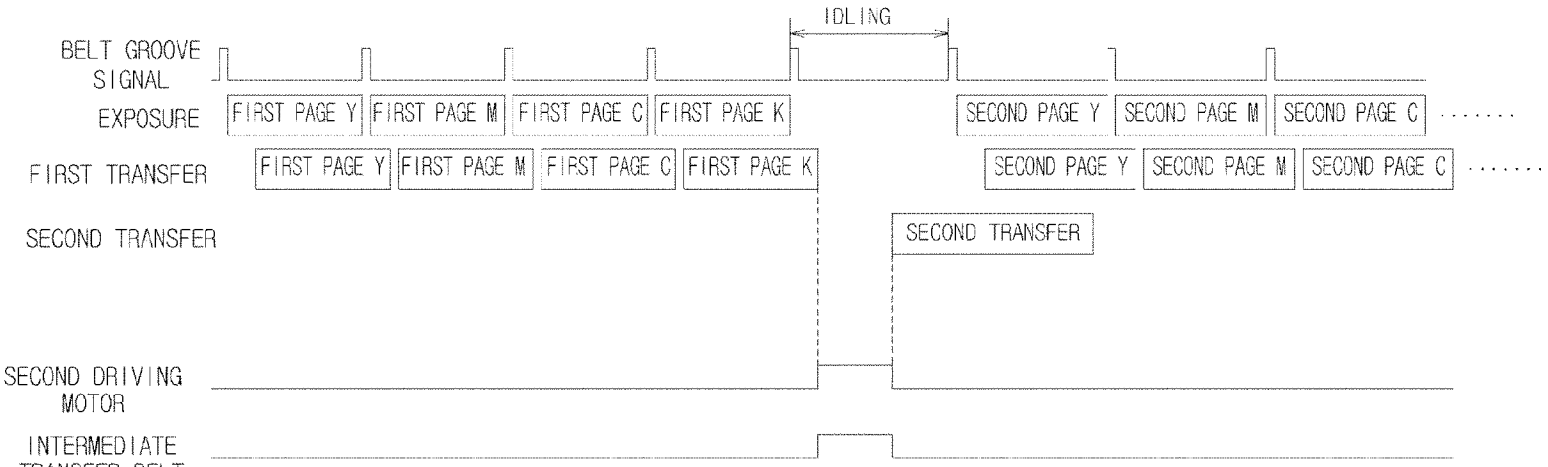
FIGS. 10A and 10B are timing charts illustrating an image forming apparatus to consecutively print color images on more than two sheets according to an embodiment of the present general inventive concept
Figure 10B:
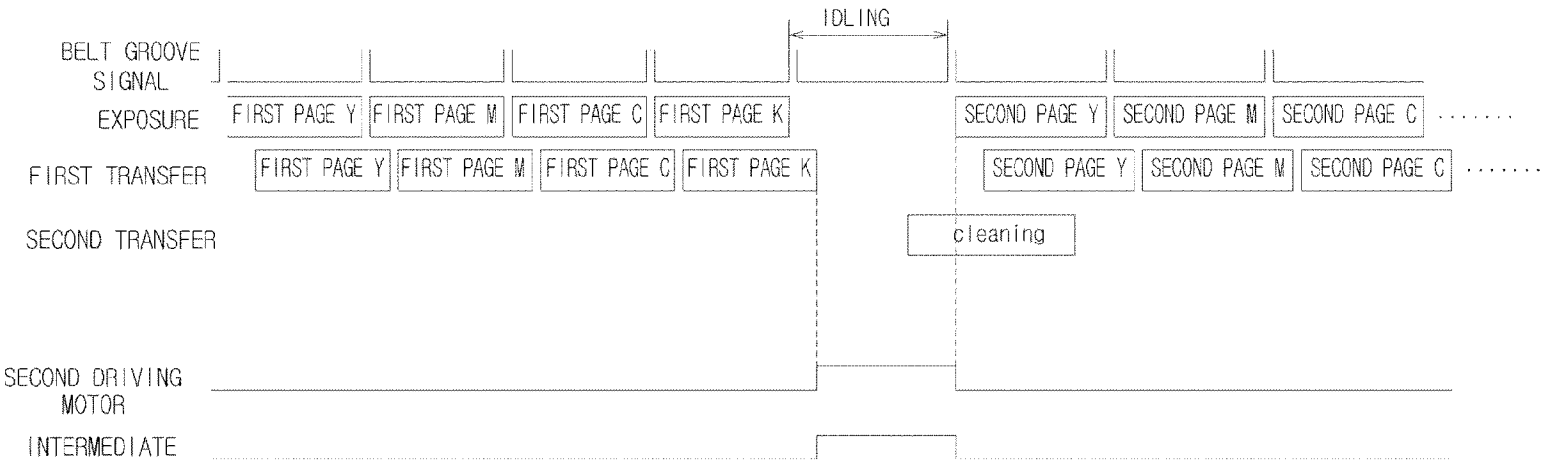

FIGS. 10A and 10B are timing charts illustrating an operation of an image forming apparatus to consecutively print color images on more than two paper sheets according to an embodiment of the present general inventive concept.

Referring to FIG. 10A, thr image forming apparatus according to the embodiment as described on FIG. 9, after completing the exposures from the yellow 'Y' to the black 'K', one idling period is proceeded, and then an exposure with respect to the next color image is started, and during the idling period, the second transfer is started.

As to reduce the overall printing time, during the period from the moment after the first transfer with respect to the last color of the first color image is completed to the moment prior to the starting of the second transfer, the speed of the second driving motor is increased, so that the rotation speed of the intermediate transfer belt 141 is accelerated. At this time, the acceleration rate of the rotation speed may be set higher than a regular rotation speed, at about 125%, for example, but the present disclosure is not limited hereto. Through such, the overall printing time may be reduced.

In addition, as illustrated on FIG. 10B, during the period from the moment after the first transfer with respect to the black 'K' of the first color image is completed to the moment prior to the starting of the exposure with respect to the yellow 'Y' of the next color image, the rotation speed of the intermediate transfer belt 141 may be accelerated.

Figure 11:
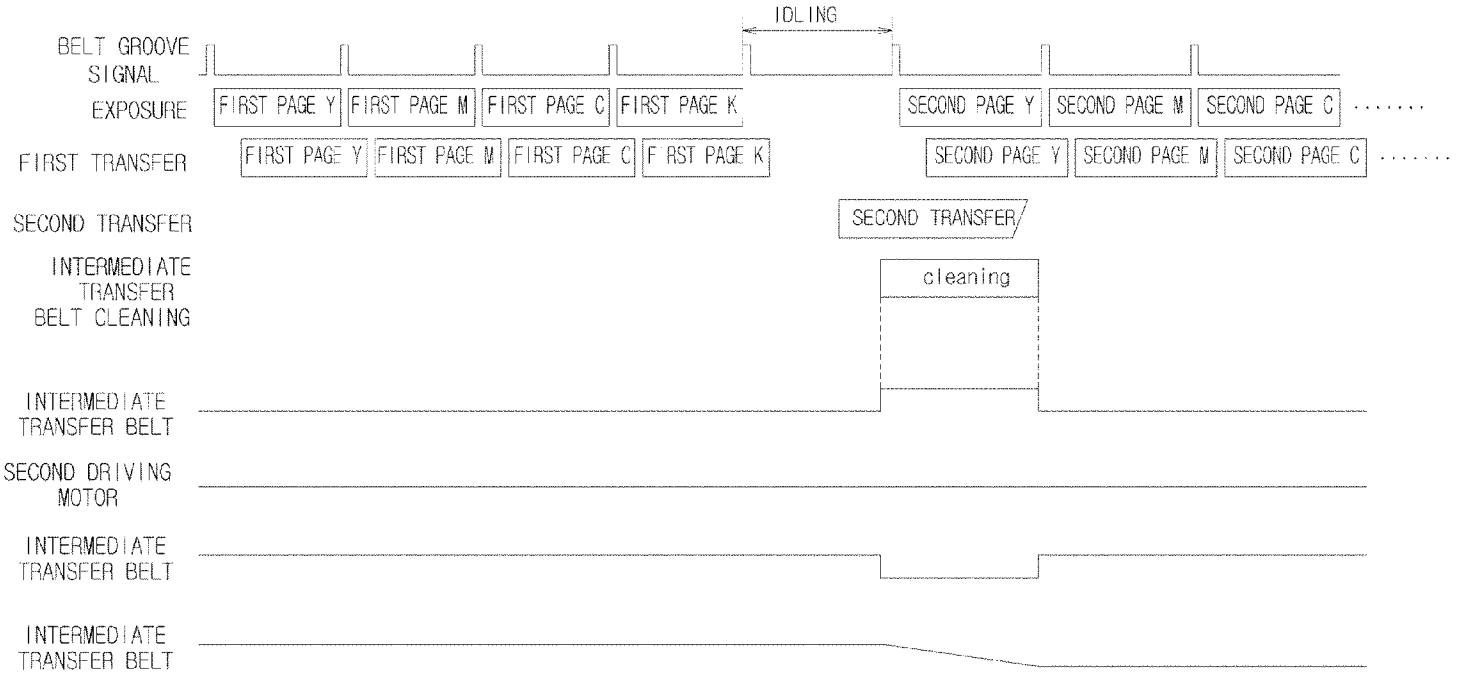
FIG. 11 is a timing chart illustrating an operation of a transfer belt cleaning unit.

In a case when a plurality of color images is consecutively printed, prior to the performing of the first transfer with respect to the next color image, the transfer belt cleaning unit 170 performs a cleaning task of the intermediate transfer belt 141. FIG. 11 is a timing chart illustrating the operation of a transfer belt cleaning unit.

Referring back to FIG. 2, the cleaning member 171 of the transfer belt cleaning unit 170 is positioned at one side of the intermediate transfer belt 141 and configured to scrape off the remaining waste toner by making contact with the outer circumferential surface of the intermediate transfer belt 141, and is spaced apart from or makes contact with the intermediate transfer belt 141 by the fourth driving unit (not illustrated) However, FIG. 2 is only one embodiment of the transfer belt cleaning unit 170, and the present general inventive concept is not limited thereto. The form and the position of the transfer belt cleaning unit may be determined according to a design or user preference.

Referring to FIG. 11, in a case when more than two sheets of one or more color images are consecutively printed, the exposure and the first transfer with respect to the second color image may be performed during the cleaning task with respect to the first color image to reduce the printing time.

For the cleaning task, when the cleaning member 171 makes contact with the intermediate transfer belt 141, a load (hereinafter called the 'cleaning load') is generated at the intermediate transfer belt 141, and the cleaning load reduces the speed of the intermediate transfer belt 141. If the speed of the intermediate transfer belt 141 is reduced while the first transfer of the yellow 'Y' is taken place, the position change of the yellow 'Y' color image, which is being transferred on the intermediate transfer belt 141, is occurred.

Figure 12A:
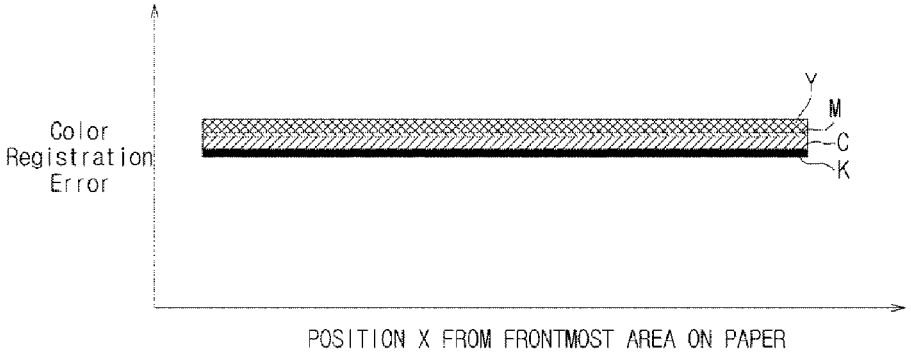
FIGS. 12A and 12B are views comparing an error occurrence of a color registration of a first color image and a second color image.
Figure 12B:
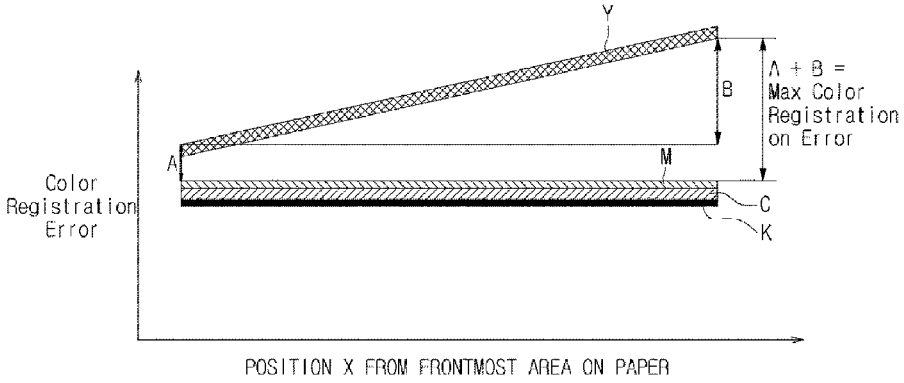

FIGS. 12A and 12B are views illustrating the error occurrence of the color registration of the first color image and the second color image.

By referring to FIG. 12A, when the first transfer with respect to the all colors of the first color image is performed, the cleaning load by the cleaning task is not occurred, and thus no color registration error is occurred, and thereby the overlapping of all the colors is occurred in a normal manner.

By referring to FIG. 12B, when the first transfer with respect to the yellow 'Y' of the second color image is performed, the cleaning load by the cleaning task is occurred, and because of such, the reduction of the speed of the intermediate transfer belt 141 as well as the position change of the yellow 'Y' toner image, which is transferred on the intermediate transfer belt 131, are occurred. Thus, the yellow 'Y' toner image is not overlapped with other toner images in a normal manner, and the color registration error is occurred, and thereby the desired color is not being able to be obtained, resulting in reduced printing quality.

Figure 13:
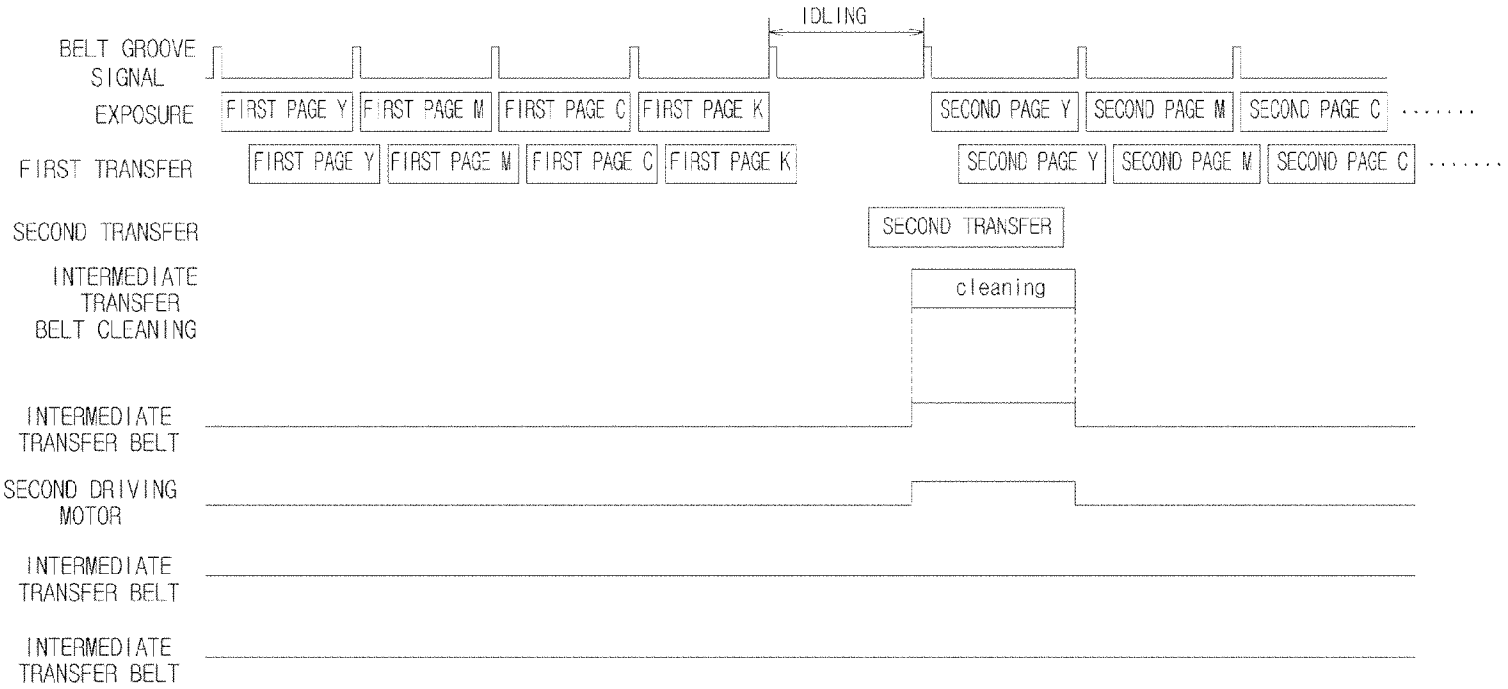
FIG. 13 is a timing chart illustrating an operation timing of an image forming apparatus and a speed change of an intermediate transfer belt according to an embodiment of the present general inventive concept.

FIG. 13 is a timing chart illustrating an operation timing of an image forming apparatus and a speed change of an intermediate transfer belt of the image forming apparatus according to an embodiment of the present general inventive concept.

Referring to FIG. 13, the image forming apparatus, after completing the exposure with respect to all the colors of the first color image, is in one idling period, and then the exposure with respect to the yellow 'Y' of the second color image is started, and during the idling period, the second transfer is started. Since the cleaning task of the transfer belt cleaning unit 170 is needed to be started after the starting of the second transfer, the reduction of the speed of the intermediate transfer belt 141 by the cleaning load may affect the first transfer with respect to the yellow 'Y' of the second color image.

Thus, the control unit 190 according to an embodiment of the present general inventive concept, while the cleaning task is performed, accelerates the speed of the second driving motor to maintain the rotation speed of the intermediate transfer belt 141 at a constant rate, so that the rotation speed of the intermediate transfer belt 141 is not reduced. At this time, the amount of the accelerating speed of the second motor may be determined by the amount of the decelerating speed of the intermediate transfer belt 141 caused by the cleaning load.

In addition, as to reduce the overall printing time, during the period from the moment after the first transfer with respect to the black 'K' of the first color image is completed to the moment prior to the starting of the second transfer, the speed of the second driving motor may be made to be accelerated.

Figure 14:
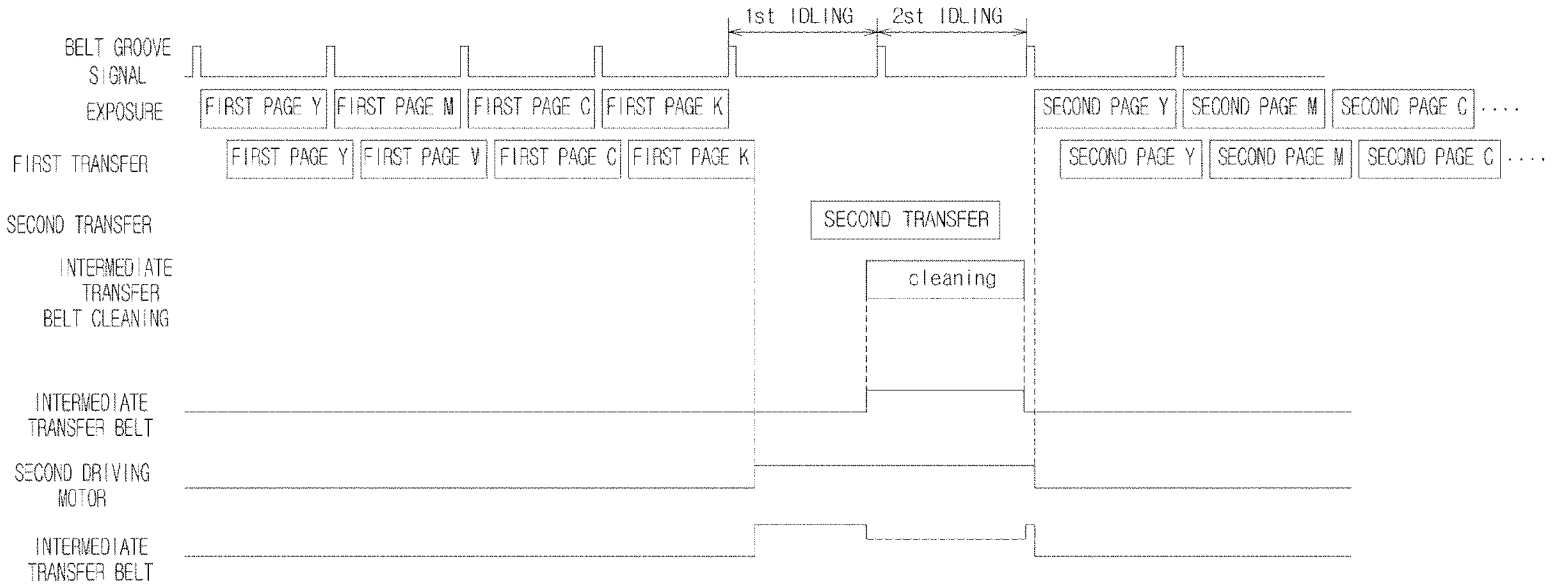
FIG. 14 is a timing chart illustrating an operation timing an image forming apparatus and a speed change of an intermediate transfer belt according to an embodiment of the present general inventive concept.

FIG. 14 is a timing chart illustrating an operation timing of an image forming apparatus and a speed change of an intermediate transfer belt of the image forming apparatus according to an embodiment of the present general inventive concept.

Referring to FIG. 14, a total of two idling periods are proceeded between the exposure with respect to the black 'K' of the first color image and the exposure with respect to the yellow 'Y' of the second color image. The second transfer with respect to the first color image is started during the first idling period, and the cleaning task is started after the starting of the second transfer the cleaning task is completed during the second idling period. Thus, prior to the exposure with respect to the yellow 'Y' of the second color image, the cleaning task may be completed, and even when the rotation speed of the intermediate transfer belt 141 is reduced by the cleaning load, the color registration error because of such is not occurred.

As to reduce the overall printing time, during the period from the moment after the first transfer with respect to the black 'K' of the first color image is completed to the moment prior to the starting of the exposure with respect to the yellow 'Y' of the second color image, the speed of the second driving motor may be accelerated. Through such, the rotation speed of the intermediate transfer belt 141 is increased during the period above, but during the period in which the cleaning load is occurred, the amount of the speed increase is less when compared to other periods.

Hereinafter, a control method of an image forming apparatus according to an embodiment of the present general inventive concept will be described.

Figure 15:
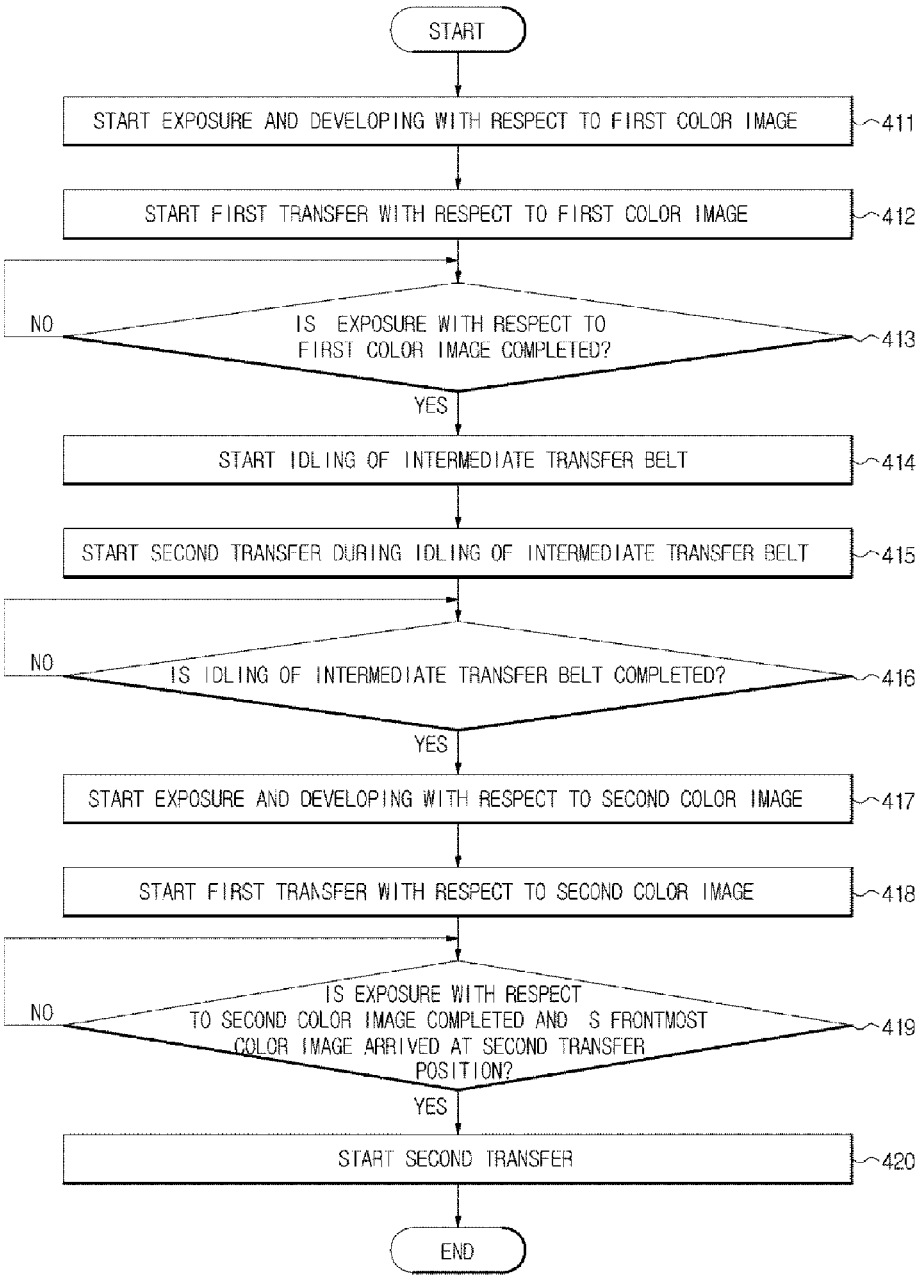
FIG. 15 is a flow chart illustrating a control method of an image forming apparatus according to an embodiment of the present general inventive concept.

FIG. 15 is a flow chart illustrating a control method of an image forming apparatus according to an embodiment of the present general inventive concept. In the present embodiment, it is assumed that the total of two color images will be printed on two respective paper sheets.

Referring to FIGS. 1, 6, and 15, the exposure and the developing with respect to the first color image are started at operation 411. When the photosensitive drum 131 is proceeded with the first one revolution, the exposure and the developing with respect to the yellow 'Y' are performed, and then, when the photosensitive drum 131 is proceeded with the second revolution, the exposure and the developing with respect to the magenta 'M' are performed. Next, when the photosensitive drum 131 is proceeded with the third revolution, the exposure and the developing with respect to the cyan 'C' are performed, and then when the photosensitive drum 131 is proceeded with the fourth revolution, the exposure and the developing with respect to the black 'K' are performed.

The exposure and the developing with respect to the yellow 'Y' of the first color image are started, and when a portion of the outer circumferential surface of the photosensitive drum 131, at which the first exposure and the first developing are taken place, is in contact with the intermediate transfer belt 141, the first transfer with respect to the first color image is started at operation 412. The first transfer, as same as the exposure, is taken place with respect to each color of the yellow 'Y', the magenta 'M', the cyan 'C', and the black 'K'.

When the exposure with respect to all the colors of the first color image is completed ('YES' from operation 413), the exposure with respect to the yellow 'Y' of the second color image is not started immediately, but the intermediate transfer belt 141 is proceeded with the idling for one single revolution at operation 414. Here the idling is referred to as the revolution of the intermediate transfer belt 141 with respect to the photosensitive drum 131 during which no exposure is taken place.

Then, during the idling period, the second transfer is started at operation 415. That is, the control unit enables the third driving unit to have the transfer roller to make contact with the intermediate transfer belt 141. Particularly, when the toner image, which is to be transferred to the paper first, among the toner images transferred on the intermediate transfer belt 141 is arrived at the position of the transfer roller, that is, the position at which the second transfer is taken place, the second transfer is started. At this time, the exposure and the first transfer are not taken place, and thus, even when an impact is delivered to the photosensitive drum 131 or to the intermediate transfer belt 131 by the contact of the transfer roller and the intermediate transfer belt 131, the shaking of the exposure position or the band by the contact are not occurred.

The rotation speed of the intermediate transfer belt 141 may be controlled to ease the reduction of the printing speed caused by the idling, by accelerating the rotation speed of the intermediate transfer belt 141 during the period from the moment after the first transfer with respect to the black 'K' of the first color image is completed to the moment prior to the second transfer is started. In addition, the acceleration may be maintained even after the second transfer is started, and prior to the starting of the exposure with respect to the second color image, the rotation speed of the intermediate transfer belt 141 may be enabled to return to the original speed.

When the idling of the intermediate transfer belt 141 is completed ('YES' from operation 416), the exposure and the developing with respect to the yellow 'Y' of the second color image are started at operation 417, and as same as the first color image, when the portion of the outer circumferential surface of the photosensitive drum 131, at which the first exposure and the first developing are taken place, is in contact with the intermediate transfer belt 141, the first transfer is started at operation 418.

The exposure with respect to the black 'K' is completed, and when the color image that is to be printed on a paper first, that is, the color that is to be printed at the front most area of a paper, is arrived at the second transfer position, the second transfer with respect to the second color image is started at operation 420. At this time, by accelerating the rotation speed of the intermediate transfer belt 141 during the time from the completion of the first transfer with respect to the black 'K' to the completion of the second transfer, the overall printing time may be able to be reduced.

Figure 16:
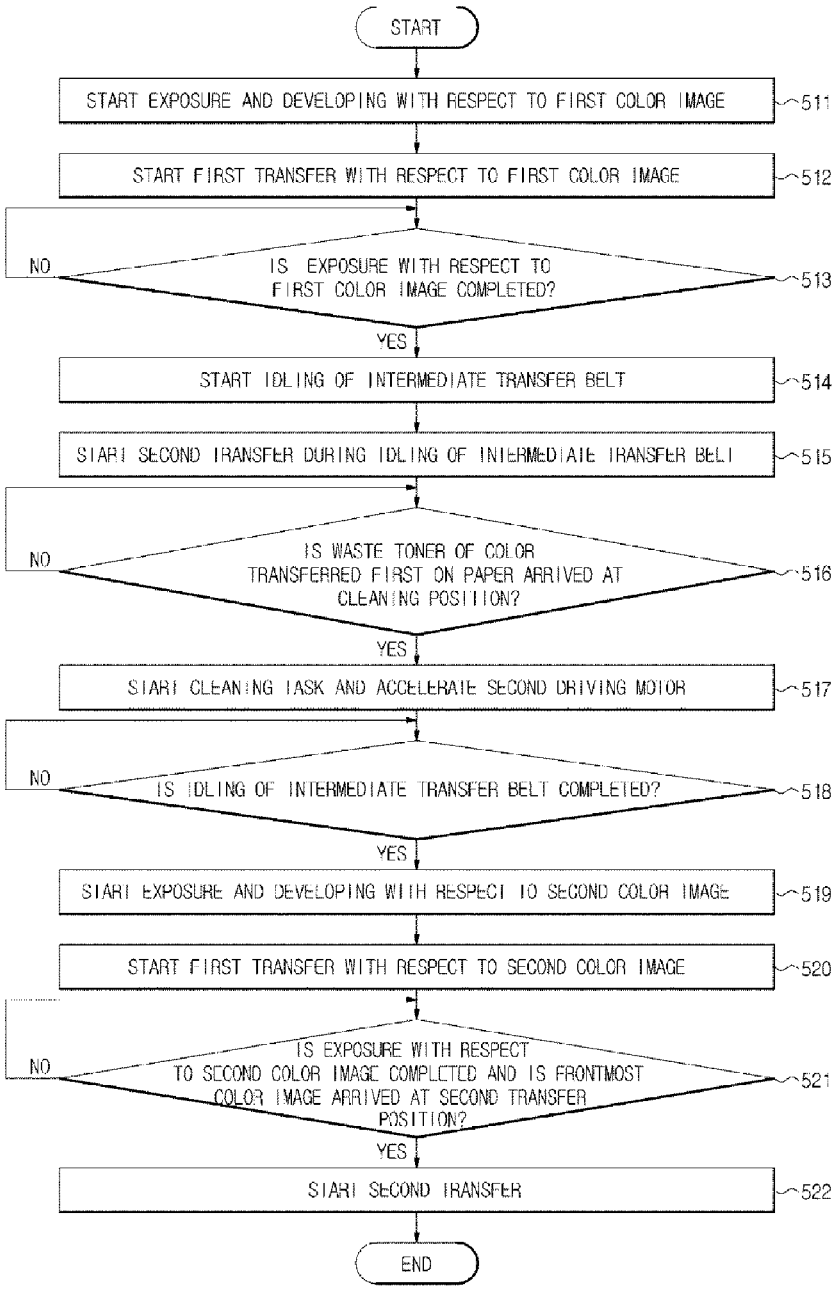
FIG. 16 is a flow chart illustrating a control method of an image forming apparatus to prevent a color registration error according to an embodiment of the present general inventive concept.

As already described earlier, in a case when more than two paper sheets of color images are being consecutively printed, the cleaning task to remove the remaining waste toner on the intermediate transfer belt 131 after the second transfer with respect to the first color image, is performed as well during the first transfer with respect to the second color image, and the cleaning load generated because of such may cause the color registration error, and thus, hereinafter, the embodiment of the present disclosure to prevent the color registration error by the cleaning load will be described. FIG. 16 is a flow chart illustrating control method of an image forming apparatus to prevent a color registration error according to an embodiment of the present general inventive concept.

Referring to FIG. 16, operations 511 to 515 of FIG. 16 are same as operation 411 to 415 of FIG. 15, and thus, the descriptions thereof will be omitted.

When the second transfer is started, and the waste toner with respect to the toner image, which is transferred first on a paper, is arrived at the position of the transfer belt cleaning member, that is, the cleaning position ('YES' from operation 515), the cleaning member that is being spaced apart from the intermediate transfer belt 141 is made to be in contact with the intermediate transfer belt 141 to remove the waste toner that remains after the second transfer is completed, and the speed of the second driving motor is accelerated at operation 516. As the speed of the second driving motor is accelerated during the cleaning task, the speed of the intermediate transfer belt 141 may be made not to be reduced even if the cleaning load is generated. The amount of the acceleration of the second driving motor may be determined by the amount of the deceleration of the intermediate transfer belt 141 caused by the cleaning load.

When the idling is completed ('YES' from operation 518), the exposure with respect to the yellow 'Y' of the second color image is started, and operations 519 to 522 of FIG. 16 are same as operations 417 to 420 of FIG. 15. Therefore, detail descriptions thereof will be omitted.

Figure 17A:
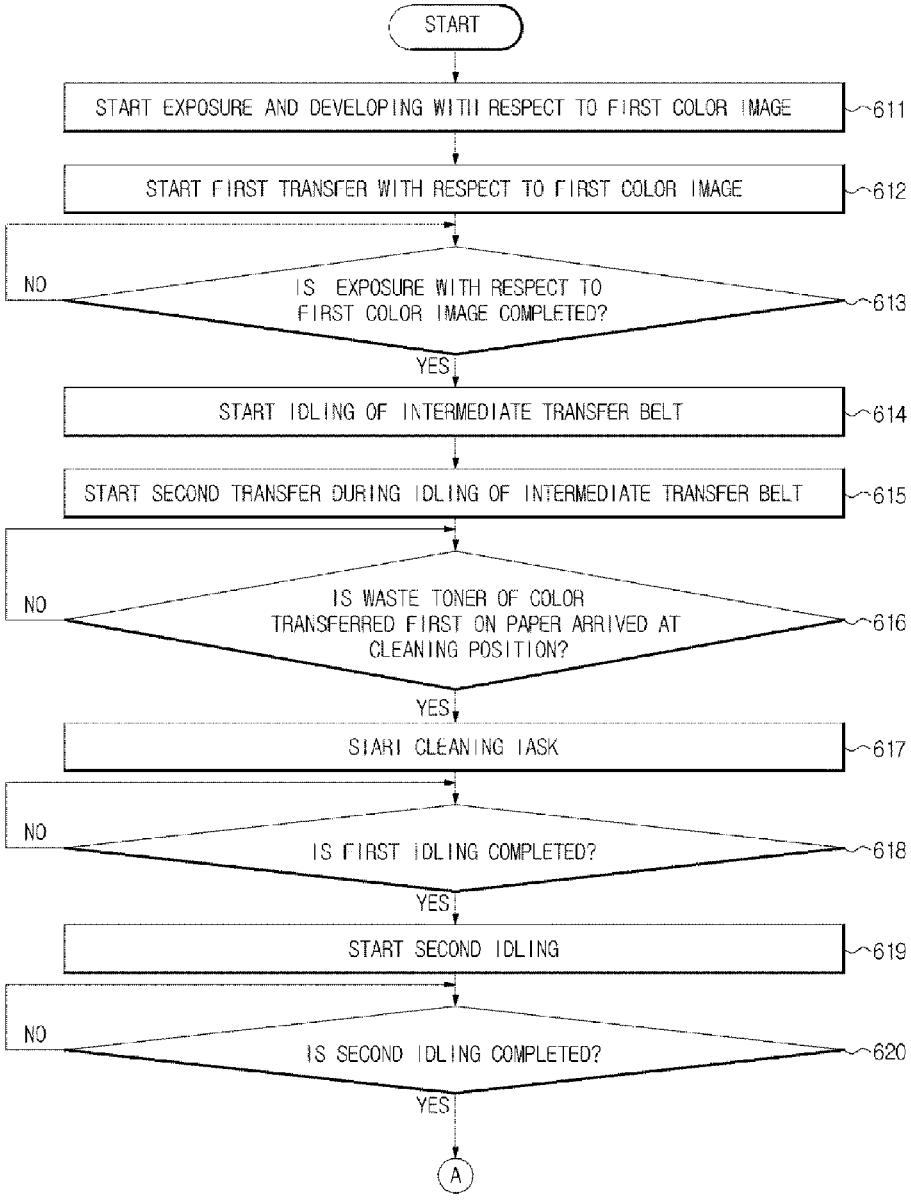
FIGS. 17A and 17B are flow charts illustrating a control method of an image forming apparatus according to an embodiment of the present general inventive concept.
Figure 17B:
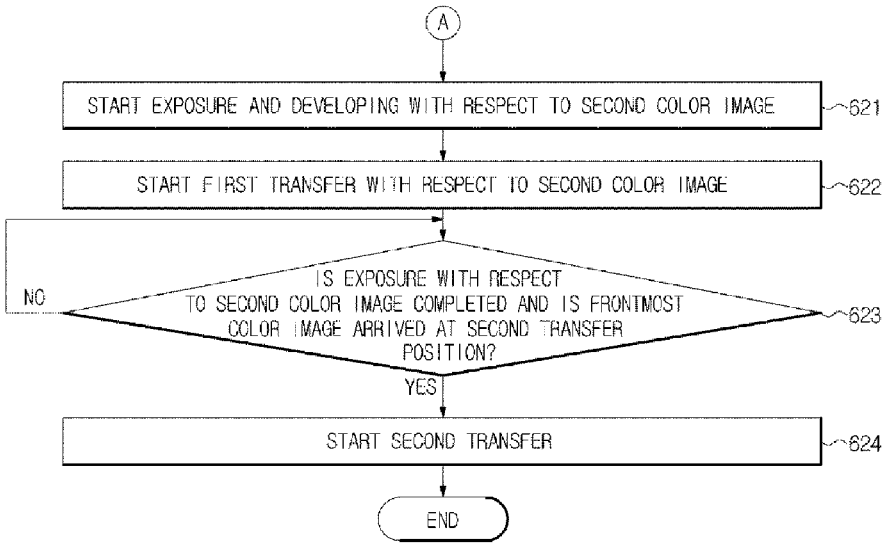

FIGS. 17A and 17B are flow charts illustrating a control method of an image forming apparatus according to an embodiment of the present general inventive concept.

Referring to FIGS. 17A and 17B, operations 611 to 613 of FIG. 17*a* are same as operations 511 to 513 of FIG. 15, and thus, the descriptions of such will be omitted.

After the exposure with respect to the all colors of the first color image is completed, the intermediate transfer belt 141 is proceeded with the idling for two revolutions. That is, when the exposure with respect to the black 'K' of the first color image is completed, until the intermediate transfer belt 141 is completed with the idling for two revolutions, the exposure with respect to the yellow 'Y' of the second color image is not started.

The first idling with respect to the intermediate transfer belt 141 is started at operation 614. During the first idling period, the second transfer with respect to the first color image is started at operation 615, and after the second transfer is started, when the remaining waste toner with respect to the toner image that is transferred first to a paper is arrived at the cleaning position ('YES' from operation 616), the cleaning task with respect to the intermediate transfer belt 141 is started at operation 617. When the first idling is completed at operation 618, the second idling is started at operation 619. Thus, prior to the starting of the exposure with respect to the yellow 'Y' of the second color image, the cleaning task is entirely completed. Thus, even if the rotation speed of the intermediate transfer belt 141 is reduced due to the cleaning load, the color registration error because of the cleaning load is not occurred.

In addition, during the period from the moment of the completion of the first transfer with respect to the color image to the moment prior to the starting of the exposure with respect to the second color image, the speed of the second driving motor is increased, so that the entire printing time may be able to be reduced.

After the second idling is completed ('YES' from operation 620), the exposure with respect to the yellow 'Y' of the second color image is started at operation 621, and operations 622 to 624 of FIG. 17B, which correspond to the first transfer and the second transfer, are same as operations 520 to 522 of FIG. 15. Therefore, detail descriptions thereof will be omitted.

The present general inventive concept can also be embodied as computer-readable codes on a computer-readable medium. The computer-readable medium can include a computer-readable recording medium and a computer-readable transmission medium. The computer-readable recording medium is any data storage device that can store data as a program which can be thereafter read by a computer system. Examples of the computer-readable recording medium include read-only memory (ROM), random-access memory (RAM), CD-ROMs, magnetic tapes, floppy disks, and optical data storage devices. The computer-readable recording medium can also be distributed over network coupled computer systems so that the computer-readable code is stored and executed in a distributed fashion. The computer-readable transmission medium can transmit carrier waves or signals (e.g., wired or wireless data transmission through the Internet). Also, functional programs, codes, and code segments to accomplish the present general inventive concept can be easily construed by programmers skilled in the art to which the present general inventive concept pertains.

As described above, the quality of an image can be improved by removing the band that occurs on a color image formed on a printing medium. In addition, by restraining the occurrence of the registration offset of a particular color, the color registration may be reduced, thereby improving the quality of an image. In addition, the improving of the quality of an image can be achieved by controlling the rotation of an intermediate transfer belt, the time of transferring to a recording medium, and the time of performing a cleaning task without a separate mechanical change, and thus no addition cost are not occurred.

As described above, the image forming apparatus and the control method thereof in accordance with the embodiments of the present disclosure can prevent the band from being generated on a color image caused by the shaking of the exposure position by starting the second transfer during the idling period in which no exposure is performed, and can reduce the entire printing time by controlling the speed of the second driving motor.

In addition, by accelerating the speed of the second driving motor while the cleaning task with respect to the intermediate transfer belt 141 is being performed, or by placing the idling period for two revolutions between the exposure of the last color and the exposure of the first color of the next color image, the color registration caused by the cleaning load may be prevented. Through such, the quality of the color image transferred on a paper may be enhanced.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. An image forming apparatus configured to generate a color image using a multi pass scheme, the image forming apparatus comprising:

a photosensitive unit comprising a photosensitive drum having an outer circumferential surface on which electrostatic latent images are formed, and a first driving unit configured to rotate the photosensitive drum;

an exposure unit configured to form the electrostatic latent images on the outer circumferential surface of the photosensitive drum by radiating light on the photosensitive drum;

a developing unit configured to form toner images by sequentially supplying a plurality of color toners to the electrostatic latent images formed on the outer circumferential surface of the photosensitive drum;

an intermediate transfer unit comprising an intermediate transfer belt on which a first transfer of the toner images formed on the outer circumferential surface of the photosensitive drum is proceeded in a sequential manner by colors, and a second driving unit configured to rotate the intermediate transfer belt;

a transferring unit comprising a transfer roller to perform a second transfer of the toner images on a printing medium by applying a predetermined pressure to the printing medium that passes in between the intermediate transfer belt and the transfer roller while in contact with the intermediate transfer belt;

a transfer belt cleaning unit configured to perform a cleaning task to remove a waste toner that remains on the intermediate transfer belt after the second transfer is performed; and a control unit configured to start idling of the intermediate transfer belt when an exposure with respect to one page is completed and the first transfer is in progress, and configured to start the second transfer by having the transfer roller make contact with the intermediate transfer belt through the printing medium while the idling of intermediate transfer belt is in progress.

2. The image forming apparatus of claim 1, wherein the control unit controls the exposure unit to start an exposure with respect to a next page after the idling is completed.

3. The image forming apparatus of claim 1, wherein the control unit controls the second driving unit to increase a speed thereof during a period from a moment of the completion of the first transfer with respect to the one image to a moment prior to the starting of the second transfer with respect to the one image.

4. The image forming apparatus of claim 1, wherein the control unit controls the second driving unit to increase a speed thereof during a period from the moment of the completion of the first transfer with respect to the one page to the moment prior to the starting of an exposure with respect to a next color image.

5. The image forming apparatus of claim 1, wherein the control unit controls the second driving unit to increase a speed thereof at a time of the cleaning task of the transfer belt cleaning unit is being performed.

6. The image forming apparatus of claim 5, wherein the control unit controls the second driving unit to increase a speed thereof according to an amount of a decelerating speed of the intermediate transfer belt caused by a cleaning load that occurs at a time of the cleaning task is being performed.

7. The image forming apparatus of claim 1, wherein the control unit controls the second driving unit to rotate the intermediate transfer belt twice in an idling state, to start the second transfer by allowing the transfer roller make contact with the intermediate transfer belt while a first idling is in progress, to have the transfer belt cleaning unit to perform the cleaning task when the waste toner remaining on the intermediate transfer belt after the second transfer is completed is arrived at a cleaning position, and to have the cleaning task to be completed when a second idling is in progress.

8. The image forming apparatus of claim 7, wherein the control unit, during a period from the moment of the completion of the first transfer with respect to the one page to the moment prior to the starting of an exposure of a next page, controls the second driving unit to increase the speed thereof.

9. A method of controlling an image forming apparatus of a multi pass scheme configured to form electrostatic latent images by exposing an outer circumferential surface of a photosensitive drum to develop the electrostatic latent images into toner images by using a plurality of color toners having different colors to each other, to perform a first transfer of the toner images to an intermediate transfer belt by colors, to perform a second transfer by having a transfer roller make contact with the intermediate transfer belt, and to remove a waste toner that remains on the intermediate transfer belt after the second transfer is performed, the method comprising:

starting idling the intermediate transfer belt when an exposure with respect to one page is completed and the first transfer is in progress; and starting the second transfer by having the transfer roller make contact with the intermediate transfer belt through a printing medium when the idling is in progress.

10. The method of claim 9, wherein the starting of the second transfer comprises starting the second transfer when a toner image, which is a toner image to be transferred on a printing medium first, among the toner images having been subject to the first transfer is arrived at a second transfer position.

11. The method of claim 9, further comprising:

during a period from the moment of the completion of the first transfer with respect to the one page to the moment prior to the starting of the second transfer with respect to the one page, increasing a speed of a driving motor that drives the intermediate transfer belt.

12. The method of claim 11, further comprising:

during a period from the moment of the completion of the first transfer with respect to the one page to the moment prior to the starting of an exposure with respect to a next color image, increasing a speed of the driving motor that drives the intermediate transfer belt.

13. The method of claim 9, further comprising:

during the time when the waste toner is being removed, increasing a speed of the driving motor that drives the intermediate transfer belt.

14. The method of claim 13, wherein an amount of the speed increase of the driving motor is determined by an amount of a decelerating speed of the intermediate transfer belt caused by a cleaning load that occurs at a time of the waste toner is being removed.

15. The method of claim 9, wherein:

the intermediate transfer belt is rotated at idling twice when the exposure with respect to the one page is completed;

during a first idling, the second transfer is started by having the transfer roller make contact with the intermediate transfer belt through a printing medium;

the cleaning task is started to remove the waste toner that remains after the second transfer is completed; and during a second idling, the cleaning task is completed.

16. The method of claim 15, further comprising:

during a period from the moment of the completion of the first transfer with respect to the one page to the moment of the completion of the cleaning task, increasing the speed of the driving motor that drives the intermediate transfer belt.

17. A non-transitory computer readable medium to contain computer-readable codes as a program to execute the method of clam 9.

* * * * *

UNITED STATES PATENT AND TRADEMARK OFFICE

CERTIFICATE OF CORRECTION

PATENT NO. : 8,903,260 B2
APPLICATION NO. : 13/739206
DATED : December 2, 2014
INVENTOR(S) : Sangbum Woo It is certified that error appears in the above-identified patent and that said Letters Patent is hereby corrected as shown below:

In the Claims

Claim 17; Column 19, Line 27:

Delete “clam” and insert --claim--, therefor.

Signed and Sealed this
Fifteenth Day of September, 2015

Michelle K. Lee

Michelle K. Lee
*Director of the United States Patent and Trademark Office*